US011402804B2

(12) United States Patent
Favre et al.

(10) Patent No.: US 11,402,804 B2
(45) Date of Patent: Aug. 2, 2022

(54) TIMEPIECE OSCILLATOR INSENSITIVE TO ANGULAR ACCELERATION CAUSED BY WEAR

(71) Applicant: The Swatch Group Research and Development Ltd, Marin (CH)

(72) Inventors: Jerome Favre, Neuchatel (CH); Olivier Matthey, Grandson (CH); Gianni Di Domenico, Neuchatel (CH); Baptiste Hinaux, Lausanne (CH); Dominique Lechot, Les Reussilles (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 859 days.

(21) Appl. No.: 16/242,028

(22) Filed: Jan. 8, 2019

(65) Prior Publication Data

US 2019/0250565 A1 Aug. 15, 2019

(30) Foreign Application Priority Data

Feb. 12, 2018 (EP) ..... 18156316

(51) Int. Cl.
*G04C 5/00* (2006.01)
*G04C 3/08* (2006.01)
(Continued)

(52) U.S. Cl.
CPC ..... *G04C 5/005* (2013.01); *G04B 17/20* (2013.01); *G04C 3/04* (2013.01); *G04C 3/08* (2013.01)

(58) Field of Classification Search
CPC . G04C 5/005; G04C 3/04; G04C 3/08; G04B 17/00; G04B 17/20
See application file for complete search history.

(56) References Cited

U.S. PATENT DOCUMENTS 3,937,001 A * 2/1976 Berney ..... G04C 10/00 368/159
2010/0149926 A1 6/2010 Colpo et al.
(Continued)

FOREIGN PATENT DOCUMENTS

CH 597 636 4/1978
CH 709 061 A2 6/2015
(Continued)

OTHER PUBLICATIONS

Combined Chinese Office Action and Search Report dated Jul. 3, 2020 in Patent Application No. 20190106714.3 (with partial English language translation and English translation of Category of Cited Documents), 17 pages.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece movement, including a mechanism including an inertial element arranged to oscillate or pivot about a first axis of pivoting relative to a structure of the movement, and arranged to cooperate directly or indirectly with an energy distribution wheel set that pivots relative to the structure about a second axis of pivoting parallel to or coincident with the first axis of pivoting and subjected to a torque exerted by an energy source, wherein the energy distribution wheel set meshes directly or indirectly with at least one inertia wheel set that pivots about a third axis of pivoting relative to the structure, each inertia wheel set is arranged to pivot in the opposite direction to the energy distribution wheel set, and the total inertia of the inertia wheel sets is between 60% and 140% of the inertia of the energy distribution wheel set.

30 Claims, 4 Drawing Sheets

(51) Int. Cl.
*G04C 3/04* (2006.01)
*G04B 17/20* (2006.01)

(56) References Cited

U.S. PATENT DOCUMENTS

| | | | | |
|---|---|---|---|---|
| 2012/0207001 | A1* | 8/2012 | Pittet | G04B 17/30 368/243 |
| 2013/0188461 | A1* | 7/2013 | Mallet | G04B 17/063 368/173 |
| 2013/0272100 | A1* | 10/2013 | Klinger | G04D 3/0089 368/175 |
| 2013/0340552 | A1* | 12/2013 | Zaugg | G04B 13/027 74/409 |
| 2016/0062314 | A1* | 3/2016 | Graf | G04B 18/006 368/171 |
| 2016/0357155 | A1* | 12/2016 | Di Domenico | G04B 15/06 |
| 2017/0351218 | A1* | 12/2017 | Paratte | G04B 17/20 |
| 2017/0351219 | A1* | 12/2017 | Paratte | G04D 7/084 |

FOREIGN PATENT DOCUMENTS

| | | | |
|---|---|---|---|
| CH | 709 328 | A2 | 9/2015 |
| CH | 712 631 | A1 | 12/2017 |
| CN | 103097965 | A | 5/2013 |
| CN | 106030422 | A | 10/2016 |
| CN | 106896692 | A | 6/2017 |
| CN | 107179673 | A | 9/2017 |
| EP | 2533 109 | A1 | 12/2012 |
| EP | 2 677 372 | A1 | 12/2013 |
| GB | 991742 | | 5/1965 |
| TW | 305953 | | 5/1997 |

OTHER PUBLICATIONS

European Search Report dated Aug. 13, 2018 in European Applicatioin 18156316.4, filed on Feb. 12, 2018 (with English Translation of Categories of Cited Documents).

* cited by examiner

TIMEPIECE OSCILLATOR INSENSITIVE TO ANGULAR ACCELERATION CAUSED BY WEAR

CROSS-REFERENCE TO RELATED APPLICATION

This application claims priority to European Patent Application No. 18156316.4 filed on Feb. 12, 2018, the entire disclosure of which is hereby incorporated herein by reference.

FIELD OF THE INVENTION

The invention concerns a timepiece movement, comprising a mechanism including at least one inertial element arranged to oscillate or pivot about a first axis of pivoting relative to a structure of said movement, and arranged to cooperate directly or indirectly with at least one energy distribution wheel set pivoting with respect to said structure about a second axis of pivoting parallel to or coincident with said first axis of pivoting and subjected to a torque exerted by at least one energy source.

The invention also concerns a watch comprising at least one such movement.

The invention concerns the field of timepiece mechanisms, in particular those that are sensitive to movements of the user or of the device carrying them, and whose operation is sensitive to accelerations related to wear circumstances, such as aeroplane flights, abrupt movements or being dropped. The invention is of considerable interest for ensuring protection of resonators, regulators, or drive members.

BACKGROUND OF THE INVENTION

In a conventional timepiece escape mechanism, of the Swiss lever type, the escape wheel has a variable rotational movement: during each vibration, it is initially locked by the pallets, then briefly accelerated by the torque applied by the barrel, and finally locked again. These long phases in a locked position give this type of escapement high resistance to rotational accelerations caused by wear.

Some escapements, such as the Clifford escapement, or the direct-synchronization magnetic escapement, require the escape wheel to rotate at virtually constant speed, with no stopping phase. This continuous rotation has numerous advantages, in particular an increase in the energy efficiency of the escapement, since it is no longer necessary to accelerate the escape wheel at each vibration. Conversely, these systems can become sensitive to rotational accelerations caused by wear, since the escape wheel necessarily has some inertia. In a particularly disadvantageous case, an acceleration caused by wear that obstructs the normal rotation of the wheel can temporarily or permanently stop the wheel if the escapement is not self-starting.

This problem of sensitivity to wear has not been effectively solved in the case of the Clifford escapement. It has been opted to use this type of escapement in static timepieces, such as clocks or alarm clocks, which by definition are not subjected to any acceleration caused by wear.

EP Patent No 3087435A2 in the name of The Swatch Group Research and Development Ltd discloses a device for controlling the operation of a timepiece movement that includes a magnetic escapement. This device comprises a resonator and a magnetic escapement train rotating about an axis. The train includes at least one magnetic track comprising a plurality of magnets having an angular size greater than the radial size thereof. The resonator includes at least one magnetic element intended to be coupled to the magnetic track. The coupling element is radially extended relative to the rotational axis and has a contour comprising one portion that is substantially angularly oriented when the resonator is in its rest position. When the escapement train rotates, each magnet penetrates under the coupling element and gradually accumulates a certain magnetic potential energy. Then, said magnet comes out from under the coupling element via the aforementioned portion, and the coupling element receives an impulse located around the rest position of the coupling element.

CH Patent No 709061A1 in the name of The Swatch Group Research & Development Ltd discloses a timepiece escapement mechanism comprising a stopper between a resonator and two escape wheel sets each subjected to a torque. Each escape wheel set includes a track that is magnetized or ferromagnetic over a certain period. The stopper comprises at least one magnetized or ferromagnetic pole shoe, mobile in a transverse direction relative to the direction of travel of one surface of the track; the pole shoe or the path creates a magnetic field between the pole shoe and the surface. The pole shoe is confronted by a magnetic field barrier on the track, just before each transverse motion of the stopper caused by the periodic action of the resonator. The escape wheel sets are each arranged to cooperate alternately with the stopper and are connected to each other by a direct kinematic connection.

CH Patent No 712631A1 in the name of ULYSSE NARDIN discloses an escapement wherein a lever is arranged to cause an oscillator to interact with a first and second escape wheel. An elastic device returns the lever to a first position, when the lever is between this first position and an unstable intermediate position of equilibrium. The elastic device returns the lever to a second position, when the lever is between this second position and the unstable intermediate position of equilibrium. The lever includes a first and second reloading ramp. When a tooth of the first escape wheel crosses the first reloading ramp, it moves the lever from its first position to its fourth position, which is between the first position and the unstable position of equilibrium. When a tooth of the second escape wheel crosses the second reloading ramp, it moves the lever from the second position to a fifth position, which is between the second position and the unstable position of equilibrium.

CH Patent No 709328A2 in the name of SEIKO discloses an escapement, a timepiece movement and a timepiece intended to improve the efficiency of energy transfer, while ensuring stable operation. An escapement includes a first impulse pallet stone and a second impulse pallet stone for transmitting energy to the balance/balance spring, a lever which has an entry-pallet and an exit-pallet stone, and which can be pivoted about a pallet staff, a first escape wheel set which has a first escape wheel for the impulse that comes into contact with the first impulse pallet stone, the energy being transmitted at that moment, and a second escape wheel set which has a second escape wheel for the impulse that can come into contact with the second impulse pallet stone, and an escape wheel for the stopping phase which can engage with or be separated from the entry-pallet stone and the exit-pallet stone, and which meshes with the first escape wheel set.

EP Patent No 2677372A1 in the name of MONTRES BREGUET discloses a backlash take-up timepiece wheel for meshing with a second toothing formed of second teeth of given width arranged consecutively with a second constant pitch on a pitch diameter of an opposing mobile component, the wheel including, arranged to mesh with the second toothing, a first toothing on a first pitch circle comprising a series of pairs of identical teeth arranged consecutively with a first constant pitch on said first pitch circle, each pair comprising, on either side of a radial axis, a first flexible tooth and a second flexible tooth, and the distances measured on the first pitch circle between a successively arranged first tooth and second tooth are different for each pair.

GB Patent No 991742A in the name of SEIKO discloses an electric motor, whose rotor speed variations due to angular movement of the entire motor are compensated. It comprises a flywheel mounted for rotation about an axis parallel or coaxial to that of the rotor, connected such that the flywheel rotates in the opposite direction to the rotor and has a rotational speed and moment of inertia of equal magnitude to that of the rotor. The direct current motor includes contacts for powering the field coils and a rotor driving the flywheel via toothed coils and a rotor driving the flywheel via the toothing, but the toothing can be replaced with a mechanical, electrical or hydraulic belt transmission.

CH Patent No 597636B5 in the name of EBAUCHES SA discloses a timepiece movement driven by a mainspring and regulated by an electronic circuit. A generator is driven by the mainspring via at least one part of the time display train, this generator producing an alternating current of frequency FG which powers an electronic circuit comprising a precision oscillator supplying, via a frequency divider, a reference frequency FR. A comparator of frequencies FG and FR or multiples or sub-multiples of these frequencies acts on a load circuit such that the electrical current at the generator terminals increases when FG is greater than FR and thus brakes the generator, which stabilises its rotational speed, and therefore the rotational speed of the time display members.

SUMMARY OF THE INVENTION

The invention proposes to provide a simple, low cost solution to the recurrent problem of protection against undesirable accelerations disturbing the rate or proper operation of timepiece mechanisms.

In particular, in escapements where the escape wheel rotates at a constant speed, the invention consists in adding at least one wheel set of equivalent inertia to that of the escape wheel set, but which rotates in the opposite direction in order to eliminate any rotational acceleration caused by wear.

To this end, the invention concerns a timepiece movement.

The invention also concerns a watch comprising at least one such movement.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

The invention concerns a timepiece movement 1000. This movement 1000 includes a mechanism 100, which includes at least one inertial element 10, which is arranged to oscillate or to pivot about a first axis of pivoting D1 relative to a structure 12 of movement 1000.

Figure 1:
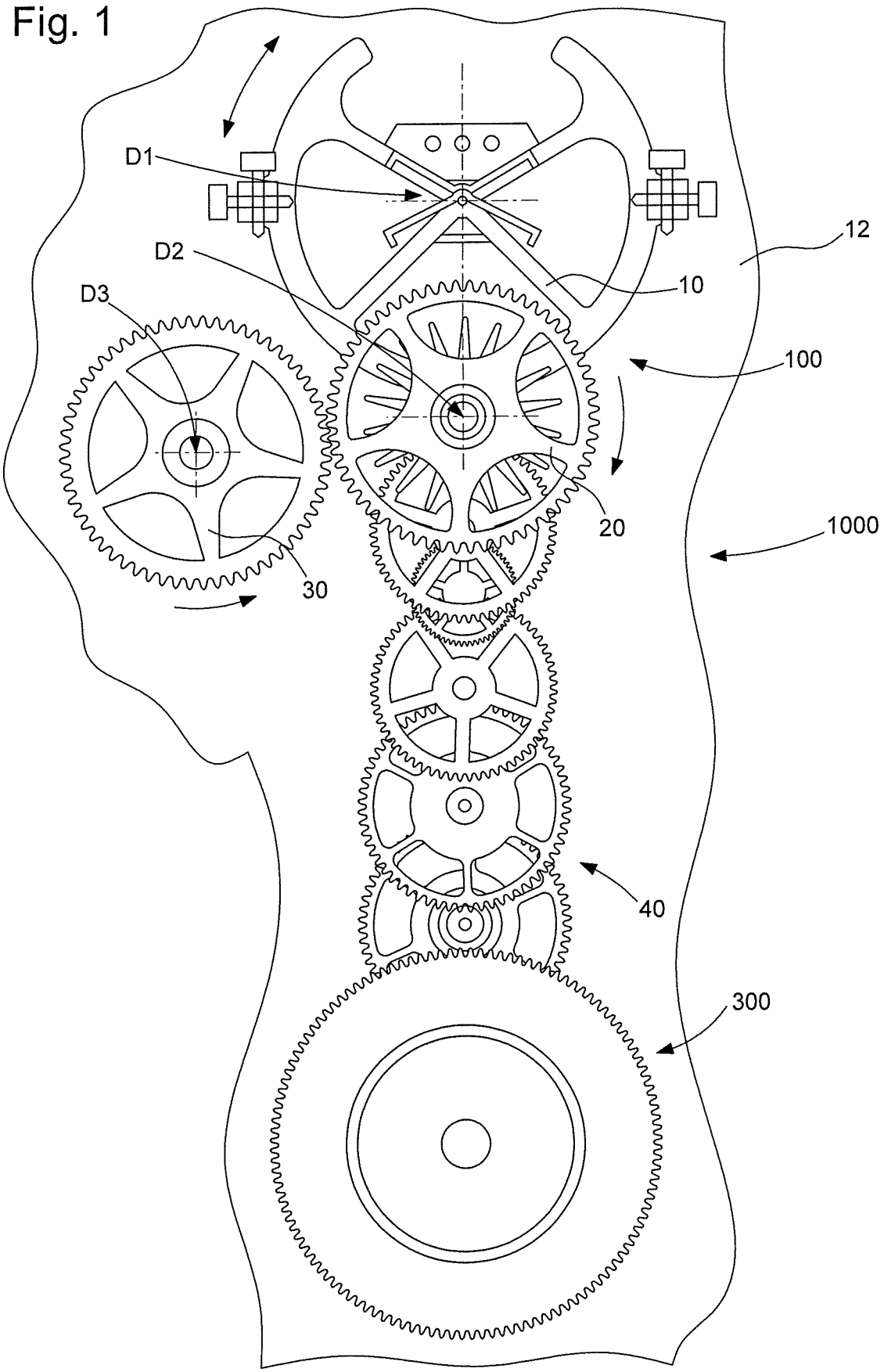
FIG. 1 represents a partial, schematic view of a timepiece movement according to the invention, comprising a strip resonator mechanism with an inertial element that oscillates under the action of flexible strips, coupled with a magnetic escapement mechanism comprising an escape wheel set and subjected to a torque exerted by an energy source via a train, the inertial element comprising magnetized areas at its periphery, arranged to cooperate directly with magnetized areas of the escape wheel set, and this escape wheel set meshes, according to the invention, with an inertia wheel set which is an idler wheel outside the train; the oscillations of the resonator are maintained by direct synchronization, without pallets, and the energy distribution wheel set, which is an escape wheel here, rotates at constant speed, without a stopping phase.

This at least one inertial element 10 is arranged to cooperate directly or indirectly with at least one energy distribution wheel set 20 that pivots relative to structure 12, about a second axis of pivoting D2, parallel to or coincident with first axis of pivoting D1, and is subjected, either directly or via a direct train 40, to a torque exerted by at least one energy source 300, such as a barrel in FIG. 1, or suchlike.

A 'direct train' means that, even if mechanism 100 includes several energy sources 300 and differential gears or similar are incorporated in the train, there is only one last wheel set of the train, directly before energy distribution wheel set 20.

The Figures illustrate the particular, non-limiting case of a single energy distribution wheel set.

According to the invention, this at least one energy distribution wheel set 20 meshes directly or indirectly with at least one inertia wheel set 30, distinct from inertial element 10, or from each inertial element 10 when there are more than one, and which pivots about a third axis of pivoting D3 relative to structure 12.

This at least one inertial element 30 is also distinct from each energy source 300. It is also distinct from train 40, when the at least one energy distribution wheel set 20 is subjected to a torque exerted by at least one energy source 300 via a train 40.

This third axis of pivoting D3 is parallel to or coincident with the second axis of pivoting D2. Each inertia wheel set 30 is arranged to pivot in the opposite direction to energy distribution wheel set 20, and the total inertia of inertia wheel sets 30 is comprised between 60% and 140% of the inertia of energy distribution wheel set 20.

More particularly, the total inertia of inertia wheel sets 30 is comprised between 90% and 110% of the inertia of energy distribution wheel set 20.

The closer the value is to the inertia of energy distribution wheel set 20, the better the insensitivity to angular acceleration caused by wear. Advantageously, inertia wheel set 30 comprises means for fine adjustment of its inertia value, for example in FIG. 2 with an array of holes on a same radius relative to third axis of pivoting D3, which holes are arranged to receive inserts of suitable mass for the desired inertia adjustment. Results are excellent with the total inertia of inertia wheel sets 30 comprised between 90% and 102% of the inertia of energy distribution wheel set 20.

More particularly still, the total inertia of inertia wheel sets 30 is equal to that of energy distribution wheel set 20.

In order to minimise energy losses following the addition of such a wheel set, it is advantageous to refine transmission by making, for example, a gear with no backlash, comprising at least one flexible toothed wheel, or similar.

Advantageously, at least energy distribution wheel set 20 or one inertia wheel set 30 includes a flexible, backlash take-up toothing, having teeth with slots separating half-toothings or toothing portions, formed either of two superposed half-wheels each including a portion of the toothing, or similar.

In a variant, this at least one energy distribution wheel set 20 meshes directly with an inertia wheel set 30, or with each inertia wheel set 30.

In another variant, the at least one energy distribution wheel set 20 meshes indirectly with at least one inertia wheel set 30 via at least one transmission wheel set distinct from inertia element 10, distinct from each energy source 300, and distinct from train 40 when the at least one energy distribution wheel set 20 is subjected to a torque exerted by at least one energy source 300 via a train 40.

In another variant, the at least one energy distribution wheel set 20 meshes indirectly with each inertia wheel set 30, via at least one transmission wheel set distinct from inertial element 10, distinct from each energy source 300, and distinct from train 40 when the at least one energy distribution wheel set 20 is subjected to a torque exerted by at least one energy source 300 via a train 40.

In a variant, at least one energy distribution wheel set 20 is connected to the at least one energy source 300 by a train 40, and at least one inertia wheel set 30 is a wheel outside train 40, meshing directly or indirectly with a wheel of train 40 and rotating in the opposite direction to energy distribution wheel set 20.

More particularly, at least one wheel outside train 40 meshes directly with a wheel of train 40.

More particularly, at least one wheel outside train 40 meshes indirectly with a wheel of train 40, via at least one transmission wheel set distinct from inertial element 10, distinct from each energy source 300, and distinct from train 40.

More particularly still, each inertia wheel set 30 is a wheel outside train 40, meshing directly or indirectly with a wheel of train 40, and which rotates in the opposite direction to energy distribution wheel set 20.

More particularly, when mechanism 100 includes a transmission wheel set, at least one such transmission wheel set includes a flexible, backlash take up toothing.

In particular, at least one inertia wheel set 30, or more particularly each inertia wheel set 30, is an idler wheel.

More particularly, energy distribution wheel set 20 meshes indirectly with at least one inertia wheel set 30 via at least one transmission wheel set. More particularly still, at least one transmission wheel set includes a flexible, backlash take up toothing.

Figure 2:
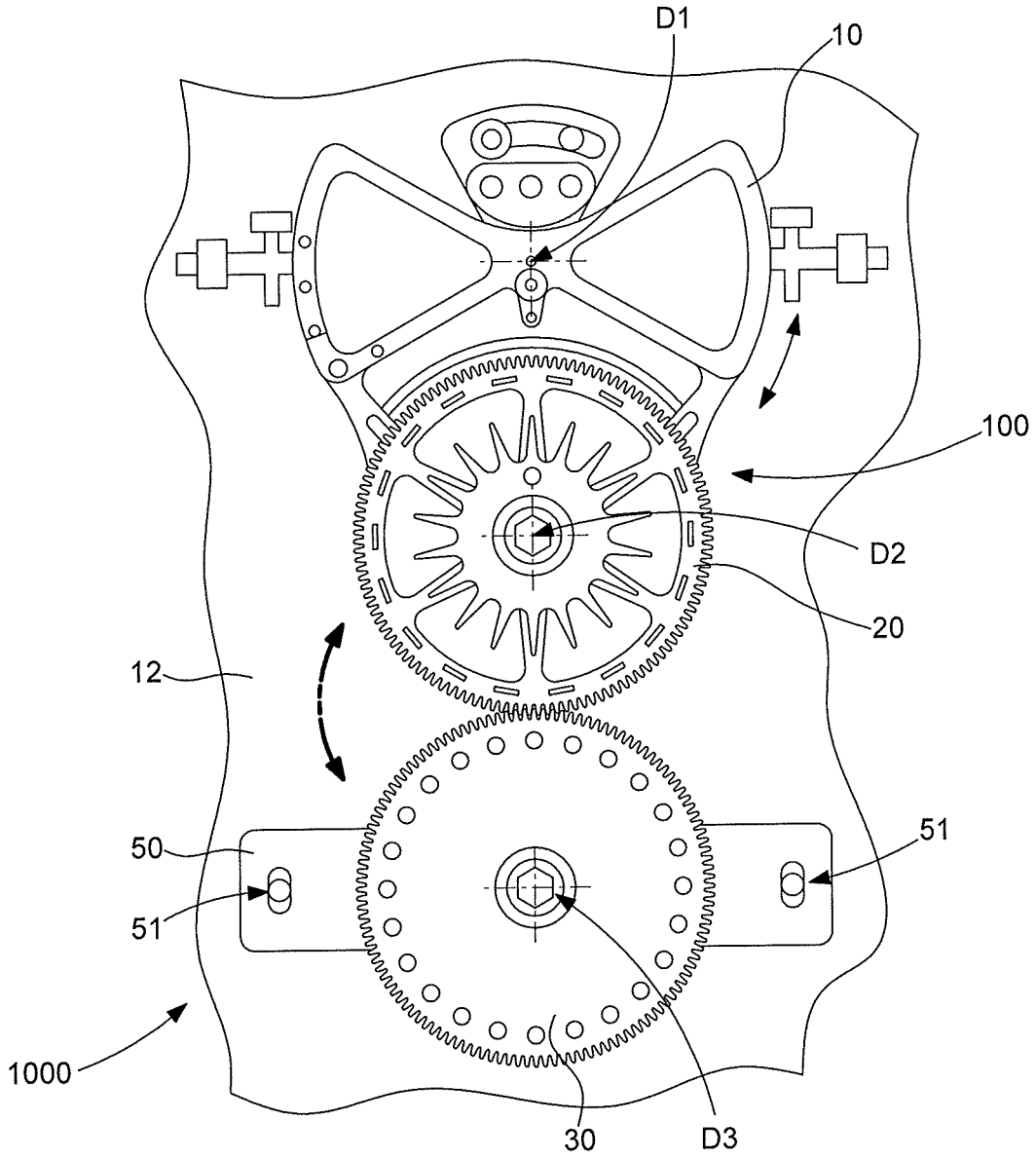
FIG. 2 represents, in a similar manner to FIG. 1, another movement comprising a similar resonator, and wherein the inertia wheel set is position adjustable and is arranged to be incorporated in the barrel train; the double dotted line arrow represents external disturbance caused by wear (random direction, intensity and centre of rotation).

More particularly but not exclusively, there is only one inertia wheel set 30, as seen in FIGS. 1 and 2.

In particular and advantageously, when there is only one inertia wheel set 30, and it is not directly meshed with energy distribution wheel set 20, the ratio Ri/Ref between inertia Ri of inertia wheel set 30 and inertia Rref of energy distribution wheel set 20 is equal to the ratio Vref/Vi between nominal rotational speed Vref of energy distribution wheel set 20 and nominal rotational speed Vi of inertia wheel set 30.

In a particular embodiment, at least a third axis of pivoting D3 of an inertia wheel set 30 which does not mesh directly with the at least one energy distribution wheel set 20 is coincident with second axis of pivoting D2.

In a particular embodiment, at least a third axis of pivoting D3 is coincident with first axis of pivoting D1.

FIG. 1 thus illustrates a variant wherein an energy distribution wheel set 20 is connected to an energy source 300 by a train 40, and at least one inertia wheel set 30, or each inertia wheel set 30, is an idler wheel outside train 40.

Figure 4:
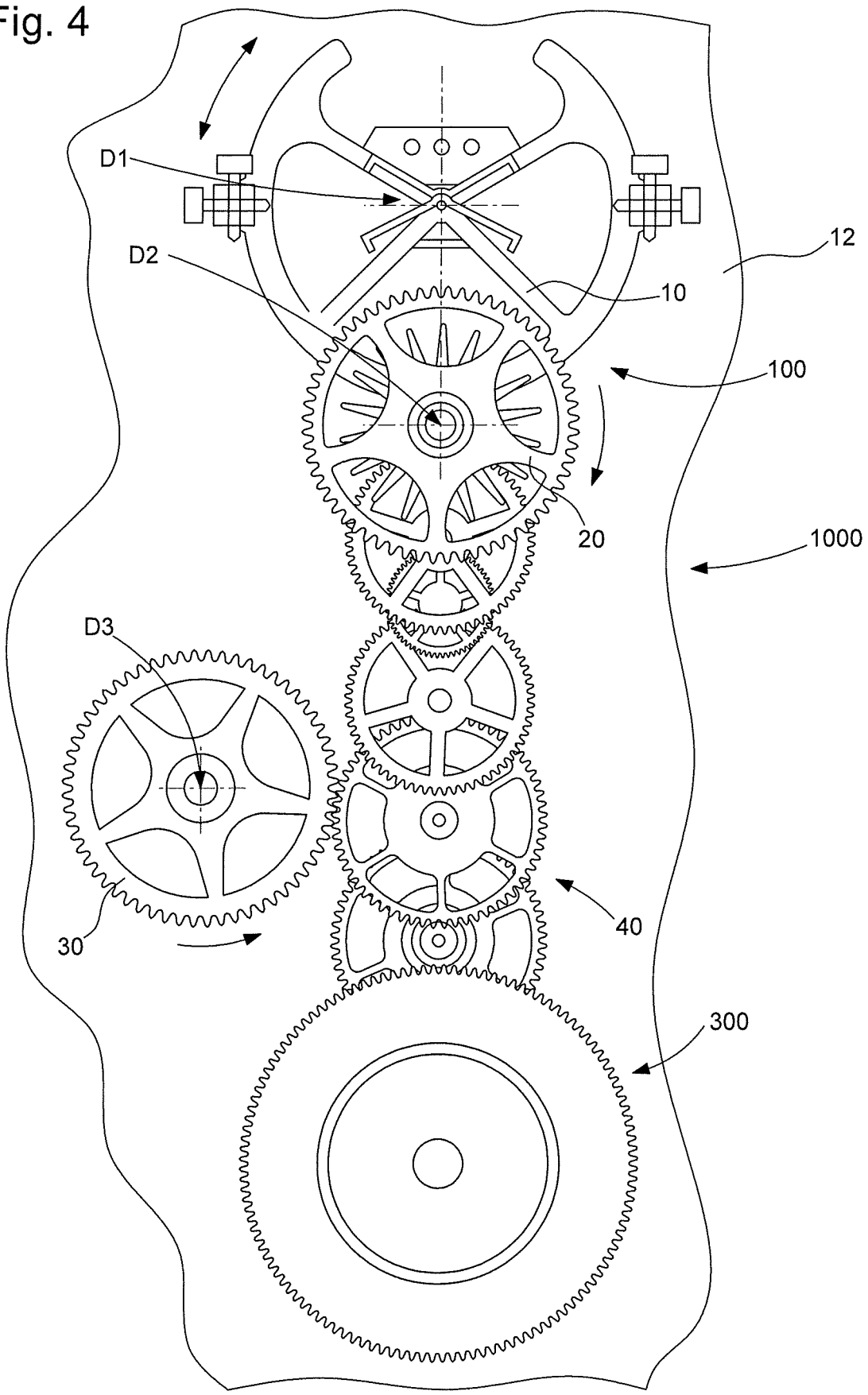
FIG. 4 represents, in a similar manner to FIG. 1, a variant wherein the inertia wheel set is meshed with a wheel of the train, between the energy source and the escape wheel, in a position of the train wherein this inertia wheel set rotates in the opposite direction to the escape wheel.

In another variant, energy distribution wheel set 20 is connected to the at least one energy source 300 by a train 40, and at least one inertia wheel set 30, or each inertia wheel set 30, is a wheel forming part of train 40, as seen in the variant of FIG. 2, which makes such an arrangement possible, with a barrel train, not represented, in mesh with inertia wheel set 30, or at least one inertia wheel set 30, or each inertia wheel set 30, and one wheel meshing with a wheel of the train as represented in FIG. 4, provided that it rotates in the opposite direction to energy distribution wheel set 20.

More particularly, mechanism 100 and energy distribution wheel set 20 are arranged to ensure continuous pivoting, without stopping, of energy distribution wheel set 20.

More particularly, mechanism 100 and energy distribution wheel set 20 are arranged to ensure pivoting of energy distribution wheel set 20 at a speed that is proportional, with a constant proportionality factor, to the value of the torque exerted by the at least one energy source 300.

More particularly and as seen in FIG. 2, inertia wheel set 30 pivots on an intermediate plate 50 which is mobile relative to structure 12, and which includes means 51 for adjusting the position of third axis of pivoting D3 relative to structure 12, such as an oblong groove/pin and/or eccentric screw or otherwise.

In a particular embodiment, and in particular in the variants illustrated in the Figures, each inertia wheel set 30 is isolated from any inertial element 10 by an energy distribution wheel set 20 which is interposed between inertia wheel set 30 and each inertial element 10. This application is well suited to contactless escapement mechanisms, such as magnetic escapements or similar.

Another particular embodiment concerns other structures, such as, for example, a natural escapement mechanism, wherein, conversely, at least one inertia wheel set 30 is arranged to transmit energy directly or indirectly to at least one inertial element 10.

More particularly, there is only one energy distribution wheel set 20.

In a particular variant, mechanism 100 is a resonator mechanism, which includes at least one inertial element 10 arranged to oscillate about first axis of pivoting D1 relative to structure 12 of movement 1000, and which is arranged to cooperate directly or indirectly with the at least one energy distribution wheel set 20.

More particularly, the resonator mechanism has no stopper, and especially no pallets.

More particularly, the at least one energy distribution wheel set 20 is an escape wheel as in the variants of FIGS. 1 and 2.

In another particular variant, mechanism 100 is a striking work regulating mechanism, which includes regulating means using eddy currents and/or return springs and/or mechanical friction and/or aerodynamic friction.

Figure 3:
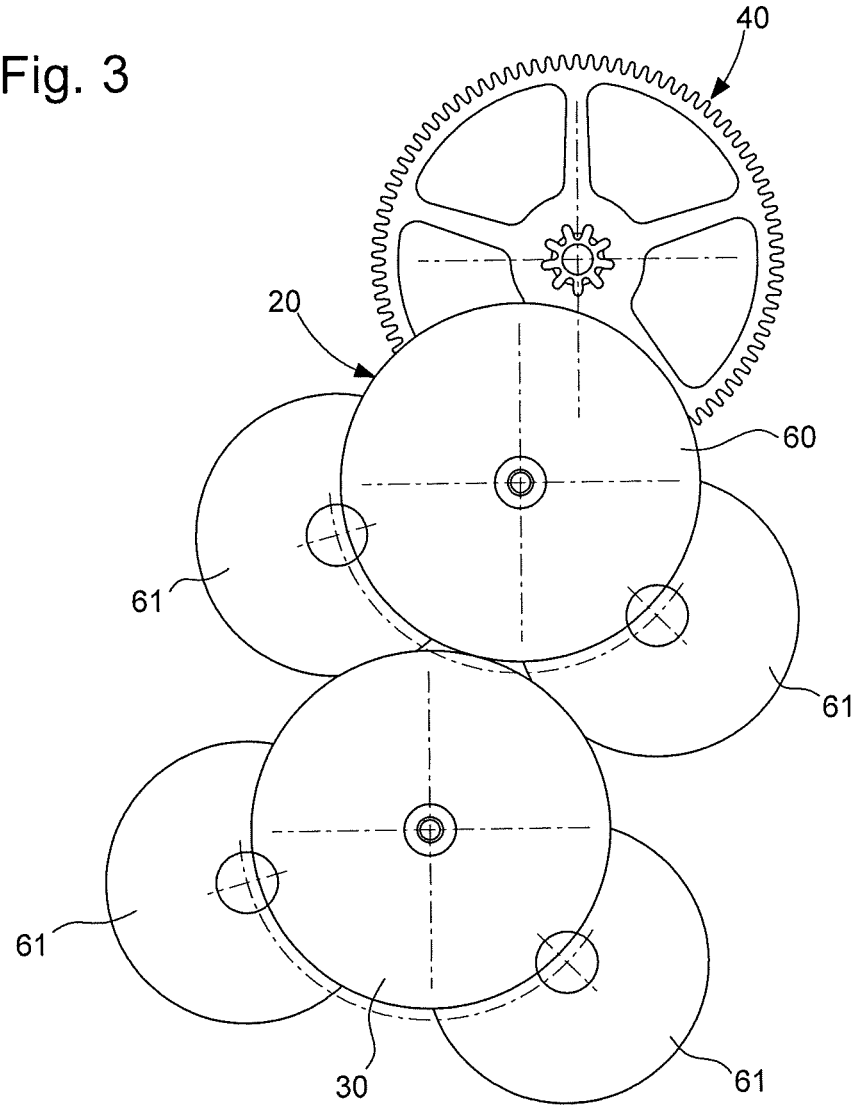
FIG. 3 represents, in a similar manner to FIG. 1, an electromechanical variant implementation of the invention, with, depending on the case, an electric generator powered by a mechanical barrel that transmits a drive torque to the energy distribution wheel set comprising a magnetic rotor cooperating with a coiled stator, or a continuous rotation electric motor comprising a battery powering a coiled stator cooperating with a rotor which is arranged to drive the energy distribution wheel set in order to drive a timepiece mechanism or a display or a hand.
Figure 5:
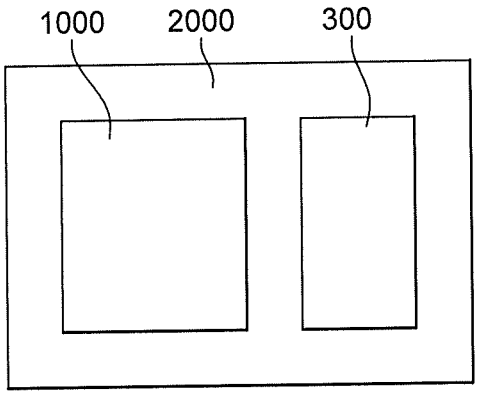
FIG. 5 is a block diagram representing a watch that comprises an energy source and a movement according to the invention.

In another particular variant represented by FIG. 3, mechanism 100 is an electromechanical mechanism which includes, either an electric generator powered by a mechanical barrel transmitting a drive torque to energy distribution wheel set 20 which includes a rotor 60 with magnetic sectors whose fields are arranged to cooperate with at least one coiled stator 61, or includes a continuous rotation electric motor comprising electric powering means or at least one battery powering a coiled stator 61 arranged to cooperate with fields transmitted by magnetic sectors of a rotor 60 arranged to drive the at least one energy distribution wheel set 20 in order to drive a timepiece mechanism or a display or a hand.

In particular, at least one inertia wheel set 30 includes a rotor 60 with magnetic sectors whose fields are arranged to cooperate with at least one coiled stator 61.

The invention also concerns a watch 2000 including at least one movement 1000 of this type. Naturally, this watch can be a wristwatch, a pocket watch, or a vehicle, aircraft, car or ship clock, for example a marine chronometer or otherwise.

The invention makes possible an economical transformation of existing movements through the addition of inertia wheel sets. It makes do with the space available, since it is not essential to have a single inertia wheel set, and it is possible, with sets of intermediate wheels, to draw maximum benefit from areas still available inside the watch case.

In short, for the particular case of an escapement mechanism, the invention proposes to add to the gear train an inertia wheel set with identical rotation to that of the escape wheel, which rotates at the same speed but in the opposite direction to the escape wheel and permanently meshes therewith.

In a particular embodiment according to FIG. 2, this inertia wheel set is located just before the escape wheel. The other embodiment according to FIG. 1 includes an inertia wheel set which is an idler wheel, used in parallel with the gear train rather than in series.

It is theoretically possible to place the inertia wheel set higher up the gear train, in other words closer to the barrel, but in practice, the inertia would have to be greater to compensate for the fact that this inertia would be added to the escape wheel pinion (and not to the wheel), and problems of taking up backlash are then more complex.

The invention is innovative compared to the aforementioned prior art, where there is no teaching disclosing an energy distribution wheel set subjected to a torque from an energy source via a direct train, this energy distribution wheel set meshing with an inertia wheel set distinct not only from the inertial element of the resonator, but also from the energy sources and from the train, and each inertia wheel set being arranged to pivot in the opposite direction to the energy distribution wheel set.

When the inertia of the inertia distribution wheel set is identical to the total inertia of all the inertia wheel sets associated therewith, the invention offers very high resistance to external accelerations, particularly to angular accelerations related to wear.

The invention claimed is:

1. A timepiece movement comprising a mechanism including at least one inertial element arranged to oscillate or pivot about a first axis of pivoting relative to a structure of said movement, and arranged to cooperate directly or indirectly with at least one energy distribution wheel set forming a single escape wheel of an escapement mechanism of the movement, the energy distribution wheel set pivoting relative to said structure about a second axis of pivoting parallel to or coincident with said first axis of pivoting and subjected to a torque exerted by at least one energy source, either directly, or via a direct train, wherein said at least one energy distribution wheel set meshes directly or indirectly with at least one inertia wheel set distinct from said inertial element, distinct from the escapement mechanism, distinct from each said energy source and distinct from said train, when said at least one energy distribution wheel set is subjected to a torque exerted by at least one energy source via a train, and said at least one inertia wheel set pivots about a third axis of pivoting relative to said structure, which third axis of pivoting is parallel to or coincident with said second axis of pivoting, and each said inertia wheel set is arranged to pivot in the opposite direction to said energy distribution wheel set, and wherein the total inertia of said inertia wheel sets is comprised between 60% and 140% of the inertia of said energy distribution wheel set.

2. The movement according to claim 1, wherein said at least one energy distribution wheel set meshes directly with at least one said inertia wheel set.

3. The movement according to claim 2, wherein said at least one energy distribution wheel set meshes directly with each said inertia wheel set.

4. The movement according to claim 1, wherein said at least one energy distribution wheel set meshes indirectly with at least one said inertia wheel set via at least one transmission wheel set distinct from said inertial element, distinct from each said energy source, and distinct from said train when said at least one energy distribution wheel set is subjected to a torque exerted by at least one energy source via a train.

5. The movement according to claim 4, wherein said at least one energy distribution wheel set meshes indirectly with each said inertia wheel set, via at least one transmission wheel set distinct from said inertial element, distinct from each said energy source, and distinct from said train when said at least one energy distribution wheel set is subjected to a torque exerted by at least one energy source via a train.

6. The movement according to claim 4, wherein at least one said transmission wheel set includes a flexible, backlash take-up toothing.

7. The movement according to claim 1, wherein said at least one energy distribution wheel set is connected to said at least one inertia wheel set by a train, and wherein at least one said inertia wheel set is a wheel outside said train, meshing directly or indirectly with a wheel of said train and rotating in the opposite direction to said energy distribution wheel set.

8. The movement according to claim 7, wherein at least one said wheel outside said train meshes directly with a wheel of said train.

9. The movement according to claim 7, wherein at least one said wheel external to said train meshes indirectly with a wheel of said train, via at least one transmission wheel distinct from said inertial element, distinct from each said energy source, and distinct from said train.

10. The movement according to claim 7, wherein each said inertia wheel set is a wheel outside said train, meshing directly or indirectly with a wheel of said train and rotating in the opposite direction to said energy distribution wheel set.

11. The movement according to claim 1, wherein at least one said inertia wheel set, or each said inertia wheel set, is an idler wheel.

12. The movement according to claim 1, wherein there is only one said inertia wheel set.

13. The movement according to claim 12, wherein, when there is only one said inertia wheel set, the ratio Ri/Ref, between the inertia Ri of said inertia wheel set and the inertia Rref of said energy distribution wheel set, is equal to the ratio Vref/Vi between the nominal rotational speed Vref of said energy distribution wheel set and the nominal rotational speed Vi of said inertia wheel set.

14. The movement according to claim 1, wherein the total inertia of said inertia wheel sets is comprised between 90% and 110% of the inertia of said energy distribution wheel set.

15. The movement according to claim 14, wherein the total inertia of said inertia wheel sets is equal to that of said energy distribution wheel set.

16. The movement according to claim 1, wherein at least said at least one energy distribution wheel set or at least one said inertia wheel set comprises a flexible, backlash take-up toothing.

17. The movement according to claim 1, wherein at least one said third axis of pivoting of one said inertia wheel set, which does not mesh directly with said at least one energy distribution wheel set, is coincident with said second axis of pivoting.

18. The movement according to claim 1, wherein at least one said third axis of pivoting is coincident with said first axis of pivoting.

19. The movement according to claim 1, wherein said mechanism and said at least one energy distribution wheel set are arranged to ensure the continuous pivoting, without stopping, of said energy distribution wheel set.

20. The movement according to claim 1, wherein said inertia wheel set pivots on an intermediate plate which is mobile relative to said structure and comprises means for adjusting the position of said third axis of pivoting relative to said structure.

21. The movement according to claim 1, wherein at least one said inertia wheel set is arranged to transmit energy directly or indirectly to at least one said inertial element.

22. The movement according to claim 1, wherein each said inertia wheel set is isolated from any said inertial element by said energy distribution wheel set.

23. The movement according to claim 1, wherein said mechanism comprises only one said inertia wheel set.

24. The movement according to claim 1, wherein said mechanism is a resonator mechanism including at least one inertial element arranged to oscillate about said first axis of pivoting relative to said structure of said movement, and arranged to cooperate directly or indirectly with said at least one energy distribution wheel set.

25. The movement according to claim 24, wherein said resonator mechanism does not have a stopper.

26. The movement according to claim 1, wherein said mechanism is a striking work regulating mechanism including regulating means using eddy currents and/or return springs and/or mechanical friction and/or aerodynamic friction.

27. The movement according to claim 1, wherein said mechanism is an electromechanical mechanism, which includes either an electric generator powered by a mechanical barrel transmitting a drive torque to energy distribution wheel set which includes a rotor with magnetic sectors whose fields are arranged to cooperate with at least one coiled stator, or includes a continuous rotation electric motor comprising electric powering means or at least one battery powering a coiled stator arranged to cooperate with fields transmitted by magnetic sectors of a rotor arranged to drive said at least one energy distribution wheel set in order to drive a timepiece mechanism or a display or a hand.

28. The movement according to claim 27, wherein at least one said inertia wheel set includes a rotor with magnetic sectors whose fields are arranged to cooperate with at least one coiled stator.

29. A watch comprising at least one movement according to claim 1.

30. A timepiece movement, comprising a mechanism including at least one inertial element arranged to oscillate or pivot about a first axis of pivoting relative to a structure of said movement, and arranged to cooperate directly or indirectly with at least one energy distribution wheel set forming a single escape wheel of an escapement mechanism of the movement, the energy distribution wheel set pivoting relative to said structure about a second axis of pivoting parallel to or coincident with said first axis of pivoting and subjected to a torque exerted by at least one energy source, either directly, or via a direct train, wherein said at least one energy distribution wheel set meshes directly or indirectly with at least one inertia wheel set distinct from said inertial element, distinct from the escapement mechanism, distinct from each said energy source, and distinct from said train, when said at least one energy distribution wheel set is subjected to a torque exerted by at least one energy source via a train, and said at least one inertia wheel set pivots about a third axis of pivoting relative to said structure, which third axis of pivoting is parallel to or coincident with said second axis of pivoting, and each said inertia wheel set is arranged to pivot in the opposite direction to said energy distribution wheel set, and wherein the total inertia of said inertia wheel sets is comprised between 60% and 140% of the inertia of said energy distribution wheel set, and wherein at least one said inertia wheel set is arranged to transmit energy directly or indirectly to at least one said inertial element.

* * * * *